US012116803B2

(12) United States Patent
Ohuchi

(10) Patent No.: US 12,116,803 B2
(45) Date of Patent: Oct. 15, 2024

(54) CONNECTION STRUCTURE BETWEEN PARTITION WALLS AND FLOOR SLAB, AND METHOD FOR CONSTRUCTING SAME

(71) Applicant: YOSHINO GYPSUM CO., LTD., Tokyo (JP)

(72) Inventor: Wataru Ohuchi, Tokyo (JP)

(73) Assignee: YOSHINO GYPSUM CO., LTD., Tokyo (JP)

( * ) Notice: Subject to any disclaimer, the term of this patent is extended or adjusted under 35 U.S.C. 154(b) by 161 days.

(21) Appl. No.: 17/759,650

(22) PCT Filed: Oct. 1, 2020

(86) PCT No.: PCT/JP2020/037445

§ 371 (c)(1),
(2) Date: Jul. 28, 2022

(87) PCT Pub. No.: WO2021/186770

PCT Pub. Date: Sep. 23, 2021

(65) Prior Publication Data

US 2023/0085256 A1 Mar. 16, 2023

(30) Foreign Application Priority Data

Mar. 19, 2020 (JP) ..... 2020-049538

(51) Int. Cl.
*E04H 9/02* (2006.01)
*E04B 2/58* (2006.01)

(52) U.S. Cl.
CPC ..... *E04H 9/021* (2013.01); *E04B 2/58* (2013.01)

(58) Field of Classification Search
CPC ... E04H 9/021; E04B 2/58; E04B 1/61; E04B 1/34; E04B 1/942

(Continued)

(56) References Cited

U.S. PATENT DOCUMENTS 3,636,672 A * 1/1972 Fink ..... E06B 1/6015 52/214
4,869,037 A * 9/1989 Murphy ..... E04B 1/642 52/748.11

(Continued)

FOREIGN PATENT DOCUMENTS

JP 2002-309691 10/2002
JP 2005-273328 10/2005

(Continued)

OTHER PUBLICATIONS

International Search Report for PCT/JP2020/037445 mailed on Dec. 8, 2020.

(Continued)

*Primary Examiner* — Paola Agudelo
(74) *Attorney, Agent, or Firm* — IPUSA, PLLC

(57) ABSTRACT

To provide a connection structure between partition walls and a floor slab, and a method for constructing the connection structure, in which a wall material facing a vertical compartment is accurately attached to studs, without any deformation of runners and damage of the connection structure even if pressing forces are applied from the studs to the runners. A connection structure 100 configured to connect a first partition wall 30 and a second partition wall 40 to a floor slab 20 is provided. The first partition wall 30 and the second partition wall 40 are connected to the floor slab 20, and separate a vertical compartment 10 from an upper floor room 13 and a lower floor room 15 that are located adjacent to the vertical compartment 10 and above and below the floor slab 20. A lower runner 31 configured to accommodate a lower end of a first stud 32 is placed on the floor slab 20. An upper runner 33 configured to accommodate an upper end of a second stud 34 that forms the second partition wall 40 is placed below the floor slab 20. A first wall material 50 is fixed to the first stud 32 through a first back batten 80A and (Continued)

fixed to the second stud 32 through a second back batten 80B. The first wall material 50 extends from the first stud 32 to the second stud 24 in the vertical compartment 10.

8 Claims, 5 Drawing Sheets

(58) Field of Classification Search
USPC ..... 52/236.6
See application file for complete search history.

(56) References Cited

U.S. PATENT DOCUMENTS

| | | | | |
|---|---|---|---|---|
| 5,027,572 | A * | 7/1991 | Purcell | E04B 1/66 52/363 |
| 5,113,631 | A * | 5/1992 | diGirolamo | E04B 5/043 52/262 |
| 5,761,864 | A | 6/1998 | Nonoshita | |
| 6,279,284 | B1 * | 8/2001 | Moras | E04F 13/007 52/483.1 |
| 7,832,174 | B2 * | 11/2010 | Way | E04B 1/163 52/236.8 |
| 8,839,582 | B2 * | 9/2014 | Aboukhalil | E04F 19/062 52/460 |
| 10,472,820 | B2 * | 11/2019 | Lutz | E04B 1/7038 |
| 10,995,497 | B1 * | 5/2021 | Horne | E04D 1/34 |
| 2011/0296789 | A1 | 12/2011 | Collins et al. | |
| 2015/0275509 | A1 * | 10/2015 | Ciuperca | B32B 5/18 52/745.09 |
| 2016/0312462 | A1 * | 10/2016 | Collins | E04B 1/94 |
| 2019/0093338 | A1 * | 3/2019 | Kennedy | E04B 1/98 |
| 2019/0383003 | A1 * | 12/2019 | Stahl, Jr. | E04B 2/7411 |
| 2022/0112716 | A1 * | 4/2022 | Yokoyama | E04B 2/7457 |

FOREIGN PATENT DOCUMENTS

| | | |
|---|---|---|
| JP | 2010-071021 | 4/2010 |
| WO | 2011/155992 | 12/2011 |

OTHER PUBLICATIONS

Written Opinion of the International Searching Authority for PCT/JP2020/037445 mailed on Dec. 8, 2020.

Office Action mailed on Oct. 16, 2023 with respect to the corresponding Chinese patent application No. 202080092325.0.

Extended European search report mailed on Jan. 5, 2024 with respect to the corresponding European patent application No. 20925988.6.

* cited by examiner

CONNECTION STRUCTURE BETWEEN PARTITION WALLS AND FLOOR SLAB, AND METHOD FOR CONSTRUCTING SAME

TECHNICAL FIELD

The present disclosure relates to a connection structure between partition walls and a floor slab, and a method for constructing the same.

BACKGROUND ART

The fire prevention and resistance performance of walls of buildings is defined by the Building Standard Law, and the structures and materials of the walls need to comply with the restrictions on interior finishing and the fire prevention and resistance performance defined by the Building Standard Law. For example, based on the use and size of buildings and zone designations, the Building Standard Law defines the buildings as fire-resistant buildings or quasi-fire-resistant buildings. In addition, from the viewpoint of the use and size of buildings, prevention of the spread of fire, evacuation, smoke, fire extinguishment, and the like, the Building Standard Law defines fire prevention and resistance performance relating to interior finishing materials, inner wall structures, building component structures, pipe spaces, and the like. Under the current Building Standard Law, non-combustibility of interior finishing materials of buildings is classified into predetermined noncombustible grades (noncombustible materials, quasi-noncombustible materials, and fire retardant materials). In addition, fire resistance of building walls is classified into predetermined construction types (fire resistive construction, quasi-fire resistive construction, fire preventive construction, and quasi-fire preventive construction).

Further, from the viewpoint of reducing the weight of a building, a fire-resistant partition wall formed by a dry method is applied as a partition wall between a vertical compartment and its adjacent spaces. In the fire-resistant partition wall, fire-resistant boards such as gypsum boards or calcium silicate boards are attached to both surfaces of studs made of light gauge steel. The vertical compartment includes elevator shafts, stairways, and the like, and the adjacent spaces include elevator halls, passageways, and habitable rooms.

When a connection structure is constructed, a vertical compartment is partitioned by a partition wall, and an upper floor room and a lower floor room, located adjacent to the vertical compartment, are disposed above and below a floor slab made of reinforced concrete. At the construction of the connection structure, the floor slab is constructed at a site and thus often has a construction error. Therefore, it is difficult to place runners on the same plane as the vertical-compartment-side end face of the floor slab, install studs (such that the studs are also on the same plane as the vertical-compartment-side end face of the floor slab), and fix a wall material facing the vertical component to the studs. For this reason, there is known a method in which a floor slab is constructed in a state in which upper and lower runners extend beyond the vertical-compartment-side end face of the floor slab, upper and lower studs are installed into the upper and lower runners, and a wall material facing the vertical compartment is fixed to the upper and lower studs.

The above method will be described in detail with reference to FIG. 1. FIG. 1 is a vertical cross-sectional view illustrating an example of a conventional connection structure between partition walls and a floor slab, in which a vertical compartment is separated from upper and lower floor rooms that are located adjacent to the vertical compartment and above and below the floor slab.

In FIG. 1, a floor slab 20 made of reinforced concrete is located at the left side of a vertical compartment 10 and is supported by a floor beam 25 formed of a structural steel material such as H-shaped steel. The floor slab 20 is constructed at a site. A connection structure 90 between partition walls and a floor slab is formed by connecting an upper first partition wall 30 and a lower second partition wall 40 to a floor slab 20 and a floor beam 25. The upper first partition wall 30 and the lower second partition wall 40 separate an upper floor room 13 and a lower floor room 15 located above and below the floor slab 20 from the vertical compartment 10.

A vertical-compartment-side end face 21 of the floor slab 20 made of reinforced concrete has projections and recesses due to a construction error. The projections and recesses are formed in the vertical direction of FIG. 1 and also in the depth direction of the paper surface of FIG. 1. Therefore, a lower runner 31, constituting part of the upper first partition wall 30 and formed of a building steel base material, is disposed on the upper surface of the floor slab 20 in a state in which the lower runner 31 extends beyond the end face 21 by a width t1. Then, the lower runner 31 is fixed to the floor slab 20 by a fixing member 70 such as a screw or a nail.

Further, runner receivers 37A and 37B are fixed to portions, on the vertical compartment side relative to a web 25*b*, of upper and lower flanges 25*a* of the floor beam 25 by welding or the like. Further, upper and lower floor beam runners 35, formed of a building steel base material, are fixed to runner receivers 37A and 37B by fixing members 70 such as screws or tapping screws, with the openings of the upper and lower floor beam runners 35 facing each other. A floor beam stud 36 is disposed within the upper and lower floor beam runners 35. The upper and lower floor beam runners 35 are fixed to the runner receivers 37A and 37B in a state in which the upper and lower floor beam runners 35 extend beyond the vertical-compartment-side end face 21 of the floor slab 20 by the width t1.

Further, a runner receiver 37C is fixed to the lower surface of the lower flange 25*a* of the floor beam 25 by welding or the like. An upper runner 33, constituting part of the lower second partition wall 40 and formed of a building steel base material, is disposed on the runner receiver 37C in a state in which the upper runner 33 extends beyond the vertical-compartment-side end face 21 by the width t1. Then, the upper runner 33 is fixed to the runner receiver 37C by a fixing member 70 such as a screw or a tapping screw.

In the first partition wall 30, a plurality of first studs 32 are installed between an upper runner (not illustrated) and the lower runner 31 at intervals in the width direction of the first partition wall 30 (in the depth direction of FIG. 1), and a second wall material 60A is attached to the surfaces on the room side of the first studs 32. In the second partition wall 40, a plurality of second studs 34 are installed between a lower runner (not illustrated) and the upper runner 33 at intervals in the width direction of the second partition wall 40 (in the depth direction of FIG. 1), and a third wall material 60B is attached to the surfaces on the room side of the second studs 34.

A first wall material 50 is attached to the surfaces on the vertical compartment side of a first stud 32, a second stud 34, and the floor beam stud 36. The first wall material 50 extends from the first stud 32 to the second stud 34, and faces the vertical compartment 10.

The first wall material 50, the second wall material 60A, and the third wall material 60B have stacked structures in which base layer materials 51, 61, and 64 and top layer materials 52, 62, and 65 are stacked in the wall-thickness direction. The first wall material 50, the second wall material 63, and the third wall material 60B are fixed to the first stud 32, the second stud 34, and the floor beam stud 36 by fixing members 70 such as screws or tapping screws. Each of the base layer materials 51, 61, and 64 and the top layer materials 52, 62, and 65 may be formed of a gypsum board. Alternatively, one of the base layer materials 51, 61, and 64 and the top layer materials 52, 62, and 65 may be formed of a gypsum board, and the other of the base layer material and the top layer material may be formed of a calcium silicate board or the like.

The first partition wall 30 is constituted by the second wall material 60A forming the upper floor room, the first stud 32, the lower runner 31, the upper runner (not illustrated), and the first wall material 50. The second partition wall 40 is constituted by the third wall material 60B forming the lower floor room, the second stud 34, the upper runner 33, the lower runner (not illustrated), and the first wall material 50. Further, a fire-resistant covering material 28 is formed in the surroundings of the floor beam 25 by spraying or the like. Accordingly, the connection structure 90, between the partition walls and the floor slab, with fire resistance performance is formed.

As illustrated in FIG. 2, a case in which a large horizontal force H is applied to the first partition wall 30 and the second partition wall 40 during, for example, a large earthquake is verified. As described above, the lower runner 31, the upper runner 33, and the floor beam runners 35 extend beyond the vertical-compartment-side end face 21 of the floor slab 20 by the width t1. Therefore, upon the horizontal force H being applied to the first partition wall 30 and the like, the first partition wall 30 and the like are subjected to out-of-plane moments due to the horizontal force H. Then, pressing forces P due to the out-of-plane moments may be applied from the first stud 32, the second stud 34, and the floor beam stud 36 to the inside corners on the vertical compartment side of the lower runner 31, the upper runner 33, and the floor beam runners 35, which are formed of a building steel base material. Then, the pressing forces P cause at least portions of the first stud 32, the second stud 34, and the floor beam stud 36 to be further shifted toward the vertical compartment side than the width t1. In addition, at least portions on the vertical compartment of the lower runner 31, the upper runner 33, and the floor beam runners 35 may bend and deform downward and upward (deformation 5). As a result, at least portions of the first stud 32, the second stud 34, and the floor beam stud 36 may come off from the lower runner 31, the upper runner 33, and the floor beam runners 35, thereby causing the connection structure 90 to be damaged. Further, considering workability, the upper ends of the second stud 34 are fitted into the upper runner 33 with clearances therebetween. The same applies to the upper ends of the first stud 32 fitted into the upper runner (not illustrated) and the upper end of the floor beam stud 36 fitted into the upper floor beam runner 35. Therefore, the upper ends of the first stud 32, the second stud 34, and the floor beam stud 36 tend to easily come off from the upper runner (not illustrated), the upper runner 33, and the upper floor beam runner 35. If the above-described large horizontal force H is applied, the first stud 32, the second stud 34, and the floor beam stud 36 may come off from the upper runner (not illustrated), the upper runner 33, and the upper floor beam runner 35, which may also cause the connection structure 90 to be damaged.

As described above, if the connection structure 90 is formed by connecting the upper first partition wall 30 and the lower second partition wall 40 to the floor slab 20, while allowing construction errors of the floor slab 20 by causing portions of the lower runner 31, the upper runner 33, and the like to extend beyond the vertical-compartment-side end face 21 of the floor slab 20, there may be a possibility that the connection structure 90 may be damaged during a large earthquake or the like.

A fire-resistant partition wall that includes a fire-resistant joint member has been proposed. The fire-resistant joint member is configured to prevent a local decrease in fire resistance performance, which may occur at an intersecting portion of a lateral joint of a base board and a vertical joint of an interior decorative board, and to improve the fire resistance performance of the partition wall. Specifically, the fire-resistant joint member is inserted into the vertical joint of the interior decorative board of the fire-resistant partition wall that extends between upper and lower horizontal fire-resistant compartments. The partition wall includes a vertical shaft member that extends between the horizontal fire-resistant compartments, the base board oriented in the horizontal direction, and the interior decorative board formed on the based board. The fire-resistant joint member includes an insertion portion configured to be inserted between the edge of the interior decorative board and the base board, and a joint bottom portion configured to conceal the joint bottom of the vertical joint. At least the intersecting portion of the lateral joint and the vertical joint, the fire-resistant joint member is disposed within the vertical joint to conceal the joint bottom of the vertical joint (see Patent Document 1, for example).

RELATED-ART DOCUMENTS

Patent Documents

Patent Document 1: Japanese Laid-open Patent Publication No. 2002-309691

SUMMARY OF THE INVENTION

Problem to be Solved by the Invention

According to the fire-resistant partition wall described in Patent Document 1, if a fire occurs in a room on one side, the temperature of the entire back surface of the partition wall increases relatively uniformly, and there is no local high-temperature region. Accordingly, the fire-resistant partition wall can have excellent fire resistance performance. However, even if the fire-resistant partition wall described in Patent Document 1 is applied, it is not possible to solve the problem described above with reference to FIG. 2, that is, it is not possible to accurately connect the wall material facing the vertical compartment to the upper and lower studs by preventing damage of the connection structure due to deformation of the upper and lower runners installed at the floor slab, while also allowing construction errors of the floor slab.

The present disclosure provides a connection structure between partition walls and a floor slab and a method for constructing the connection structure, in which a wall material facing a vertical compartment is accurately attached to studs, without any deformation of runners and damage of the connection structure even if pressing forces are applied from the studs to the runners during a large earthquake or the like.

Means to Solve the Problem

According to an embodiment of the present disclosure, a connection structure between partition walls and a floor slab is provided. The connection structure is configured to connect an upper first partition wall and a lower second partition wall to the floor slab. The upper first partition wall and the lower second partition wall separate a vertical compartment from an upper floor room and a lower floor room that are located adjacent to the vertical compartment and above and below the floor slab. A lower runner, configured to accommodate a lower end of a first stud that forms the first partition wall, is placed on the floor slab. An upper runner, configured to accommodate an upper end of a second stud that forms the second partition wall, is placed below the floor slab. A first wall material is fixed to the first stud through a first back batten and fixed to the second stud through a second back batten. The first wall material extends from the first stud to the second stud in the vertical compartment. The first partition wall is formed by a second wall material, the first stud, the lower runner, and the first wall material, the second wall material forms the upper floor room. The second partition wall is formed by a third wall material, the second stud, the upper runner, and the first wall material. The third wall material forming the lower floor room.

According to an embodiment of the present disclosure, a method for constructing a connection structure between partition walls and a floor slab is provided. The connection structure is configured to connect an upper first partition wall and a lower second partition wall to the floor slab. The upper first partition wall and the lower second partition wall separate a vertical compartment from an upper floor room and a lower floor room that are located adjacent to the vertical compartment and above and below the floor slab. The method includes a runner placement process, a stud installation process, and a partition wall forming process. The runner placement process includes placing a lower runner on the floor slab, and placing an upper runner below the floor slab. The lower runner is configured to accommodate a lower end of a first stud that forms the first partition wall, and the upper runner is configured to accommodate an upper end of a second stud that forms the second partition wall. The stud installation process includes, after accommodating and installing the lower end of the first stud in the lower runner, attaching a first back batten to a surface on a vertical compartment side of the first stud, and after accommodating and installing the upper end of the second stud in the second runner, attaching a second back batten to a surface on a vertical compartment side of the second stud. The partition wall forming process includes fixing a first wall material to the first stud through the first back batten and to the second stud through the second back batten. The first wall material extends from the first stud to the second stud in the vertical compartment. The partition wall forming process includes fixing a second wall material to the first stud such that the first partition wall is formed by the second wall material, the first stud, the lower runner, and the first wall material. The second wall material forms the upper floor room. The partition wall forming process includes fixing a third wall material to the second stud such that the second partition wall is formed by the third wall material, the second stud, the upper runner, and the first wall material. The third wall material forms the lower floor room.

Effects of the Invention

According to the present disclosure, it is possible to provide a connection structure between partition walls and a floor slab, in which a wall material facing a vertical compartment is accurately attached to studs, without any deformation of runners and damage of the connection structure even if pressing forces are applied from the studs to the runners during a large earthquake or the like.

MODE FOR CARRYING OUT THE INVENTION

In the following, a connection structure between partition walls and a floor slab, and a method for constructing the same will be described with reference to the accompanying drawings. In the specification and drawings, elements having substantially the same functions or configurations may be referred to by the same numerals and a duplicate description thereof may be omitted.

[Connection Structure Between Partition Walls and Floor Slab According to Embodiment]

Figure 3:
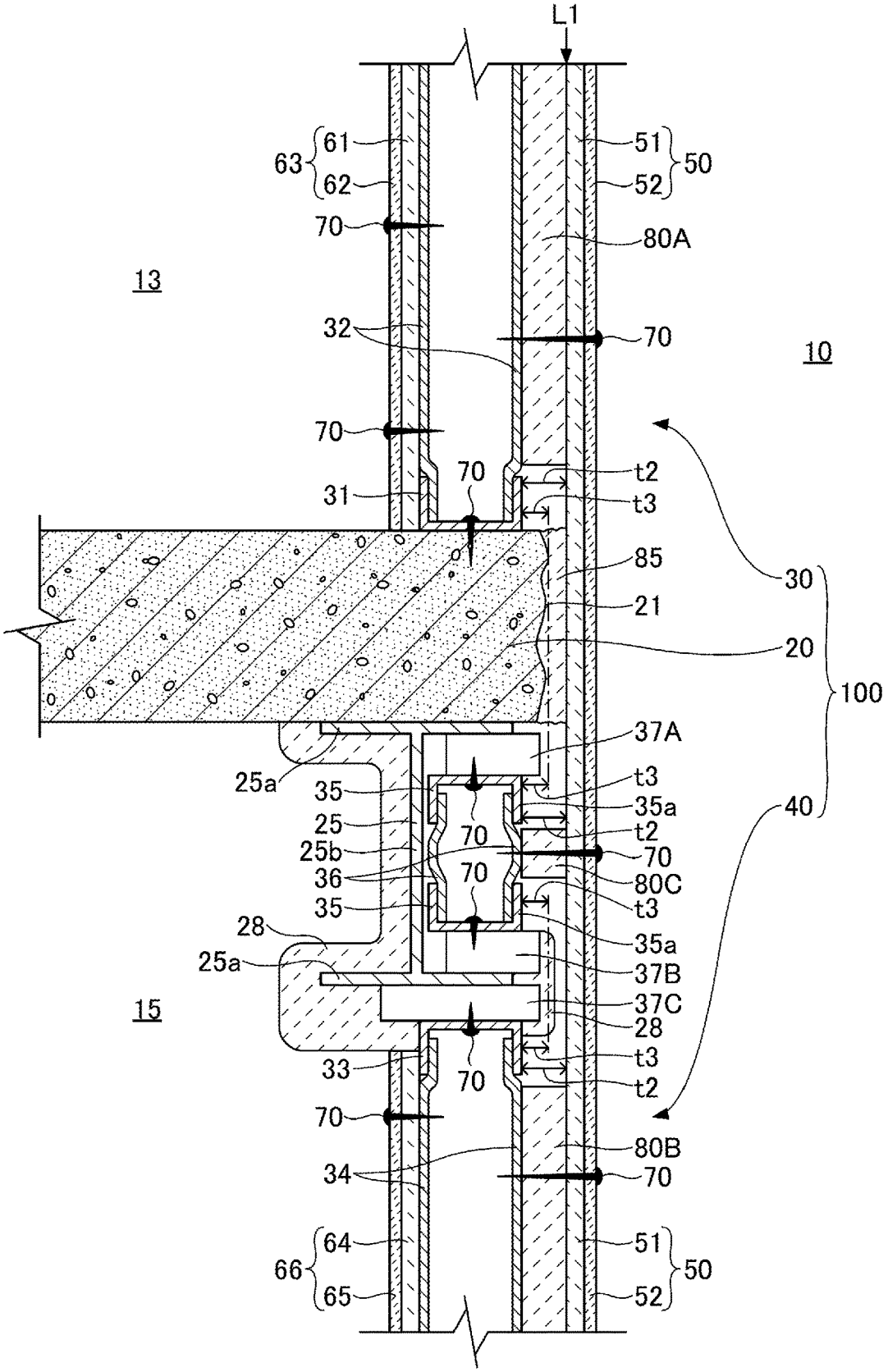
FIG. 3 is a vertical cross-sectional view illustrating an example of a connection structure between partition walls and a floor slab according to an embodiment.

First, referring to FIG. 3, an example of a connection structure between partition walls and a floor slab according to an embodiment will be described. FIG. 3 is a vertical cross-sectional view illustrating an example of a connection structure between partition walls and a floor slab according to an embodiment.

A connection structure 100 between partition walls and a floor slab illustrated in FIG. 3 is formed by connecting an upper first partition wall 30 and a lower second partition wall 40 to a floor slab 20 and a floor beam 25. The upper first partition wall 30 and the lower second partition wall 40 separate a vertical compartment 10 from an upper floor room 13 and a lower floor room 15 that are located adjacent to the vertical compartment 10 and above and below the floor slab 20.

The vertical compartment 10 to which the connection structure 100 is applied includes elevator shafts, stairways, duct shafts, piping shafts, and the like. The upper floor room 13 and the lower floor room 15, which are spaces adjacent to the vertical compartment, include elevator halls, passageways, habitable rooms, meeting rooms, management rooms, and the like. The connection structure 100 can be applied to not only steel buildings but also reinforced concrete (RC) buildings, wooden buildings, and the like. Further, buildings to which the connection structure 100 is applied include factories, warehouses, buildings, apartments, and common single-family homes.

The floor slab 20 made of reinforced concrete is constructed at a site, and a vertical-compartment-side end face 21 of the floor slab 20 has projections and recesses due to a construction error. The projections and the recesses are formed in the vertical direction of FIG. 3 and also in the depth direction of the paper surface of FIG. 3.

A lower runner 31, formed of a building steel base material and constituting part of the upper first partition wall 30, is disposed on the top surface of the floor slab 20. Specifically, the lower runner 31 is positioned so as to be set back by a width t3 toward the upper floor room relative to the vertical-compartment-side end face 21 of the floor slab 20, and is fixed to the floor slab 20 by a fixing member 70 such as a screw or a nail.

Further, runner receivers 37A and 37B are fixed to portions, on the vertical compartment side relative to a web 25*b*, of upper and lower flanges 25*a* of the floor beam 25 by welding or the like. Upper and lower floor beam runners 35 formed of a building steel base material are fixed to the runner receivers 37A and 37B by fixing members 70 such as screws or tapping screws, with the openings of the runners 35 facing each other. Further, a floor beam stud 36 is disposed within the upper and lower floor beam runners 35. When the upper and lower floor beam runners 35 are fixed to the runner receivers 37A and 37B by the fixing members 70 such as screws or tapping screws, vertical-compartment-side flanges 35*a* of the runner receivers 37A and 37B are set back by the width t3 toward the lower floor room relative to the vertical-compartment-side end face 21 of the floor slab 20. Note that the vertical-compartment-side flanges 35*a* of the upper and lower floor beam runners 35 are disposed at the lower room side between the upper runner receiver 37A and the lower runner receiver 37B.

Further, a runner receiver 37C is fixed to the bottom surface of the lower flange 25*a* of the floor beam 25 by welding or the like. An upper runner 33, formed of a building steel base material and constituting part of the lower second partition wall 40, is positioned so as to be set back by the width t3 toward the lower floor room relative to the vertical-compartment-side end face 21 of the floor slab 20. The upper runner 33 is fixed to the runner receiver 37C by a fixing member 70 such as a screw or a tapping screw.

In the first partition wall 30, a plurality of first studs 32, formed of a building steel base material with lips, are installed between an upper runner (not illustrated) and the lower runner 31. The first studs 32 are arranged at intervals (for example, at intervals of 606 mm or less, such as at intervals of 606 mm or 455 mm) in the width direction of the first partition wall 30 (in the depth direction of FIG. 3). Further, a second wall material 63 is attached to the surfaces on the room side of the first studs 32.

In the second partition wall 40, a plurality of second studs 34, formed of a building steel base material with lips, are installed between the lower runner (not illustrated) and the upper runner 33. The second studs 34 are arranged at intervals (for examples, at intervals of 606 mm or less, such as at intervals of 606 mm or 455 mm) in the width direction of the second partition wall 40 (in the depth direction of FIG. 3). Further, a third wall material 66 is attached to the surfaces on the room side of the second studs 34.

Note that a first stud 32, a second stud 34, and the floor beam stud 36 may be formed of rectangular steel, instead of a building steel base material with lips. As a building steel base material used for the first stud 32, the second stud 34, and the floor beam stud 36, light gauge steel for general structure (JIS G 3350), a hot-dip galvanized steel sheet (JIS G 3302), or the like can be used. Further, a building steel base material having a size of 45 mm to 500 mm×45 mm to 75 mm×8 mm to 32 mm and a thickness of 0.4 mm or more can be used. Further, rectangular steel having a size of 45 mm to 500 mm×40 mm to 350 mm and a thickness of 0.4 mm or more can be used.

Further, as a building steel base material used for the lower runner 31, the upper runner 33, and the floor beam runners 35, light gauge steel for general structure (JIS G 3350), a hot-dip galvanized steel sheet (JIS G 3302), or the like can be used. Further, light gauge steel for general structure, a hot-dip galvanized steel sheet, or the like having a size of 45 mm to 500 mm×35 mm to 75 mm and a thickness of 0.4 mm or more can be used.

A first wall material 50 is attached to the surfaces on the vertical compartment side of the first stud 32, the second stud 34, and the floor beam stud 36. The first wall material 50 extends from the first stud 32 to the second stud 34.

The first wall material 50, the second wall material 63, and the third wall material 66 have stacked structures in which base layer materials 51, 61, and 64 and top layer materials 52, 62, and 65 are stacked in the thickness direction of the walls. The first wall material 50, the second wall material 63, and the third wall material 66 are fixed to the first stud 32, the second stud 34, and the floor beam stud 36 by fixing members 70 such as screws or tapping screws. Each of the base layer materials 51, 61, and 64 and the top layer materials 52, 62, and 65 may be formed of a gypsum plate or a gypsum board. Alternatively, one of the base layer materials 51, 61, and 64 and the top layer materials 52, 62, and 65 may be formed of a gypsum plate or a gypsum board, and the other of the base layer material and the top layer material may be formed of a calcium silicate board or the like. Examples of the gypsum board include a gypsum board specified in JIS A 6901 and having a thickness of 9.5 mm to 25 mm. Specifically, "Tiger Board (registered trademark)—Type Z", manufactured by Yoshino Gypsum Co., Ltd., may be applied. Further, the base layer materials 51, 61, and 64 are respectively bonded to the top layer materials 52, 62, and 65 with adhesives. Examples of the adhesives include vinyl acetate resin-based adhesives, acrylic resin-based adhesives, urethane-based adhesives, epoxy-based adhesives, and silicone-based adhesives.

Further, although not illustrated, one or both of the base layer material 51 and the top layer material 52 of the first wall material 50 may be provided with a slit having a width of 10 mm or less at a position under the floor beam 25. Further, the slit may be filled with a sealing material such as a polyurethane-based material, an acrylic-based material, or a silicone-based material. In addition, although not illustrated, a floor finishing material may be constructed on the floor slab 20. Further, an interior finishing material such as coating or a cloth may be applied to the surfaces of the top layer materials 62 and 65, and the interior finishing surfaces of the top layer materials 62 and 65 are exposed to the inside of the rooms. Although not illustrated, a baseboard is attached so as to extend from the floor finishing material constructed on the top surface of the floor slab 20 to the interior finishing surface.

As illustrated in FIG. 3, the first wall material 50 is fixed to the first stud 32 by a fixing member 70 such as a screw, a tapping screw, or a staple through a first back batten 80A having a thickness t2. Further, the first wall material 50 is fixed to the second stud 34 by a fixing member 70 through a second back batten 80B having the same thickness t2. Further, the first wall material 50 is fixed to the floor beam stud 36 by a fixing member 70 through a third back batten 80C having the same thickness t2.

Each of the first back batten 80A, the second back batten 80B, and the third back batten 80C may be formed of a gypsum plate, a gypsum board, a reinforced gypsum board, a non-combustible laminated gypsum board, a fiber-reinforced cement board, glass wool, rock wool, a glass fiber felt, a rock wool felt, or the like, and may have a thickness of approximately 25 mm or less and a width of approximately 40 mm or more. Note that each of the first back batten 80A, the second back batten 80B, and the third back batten 80C may have an entire thickness of more than 25 mm by stacking two or more back battens.

Figure 1:
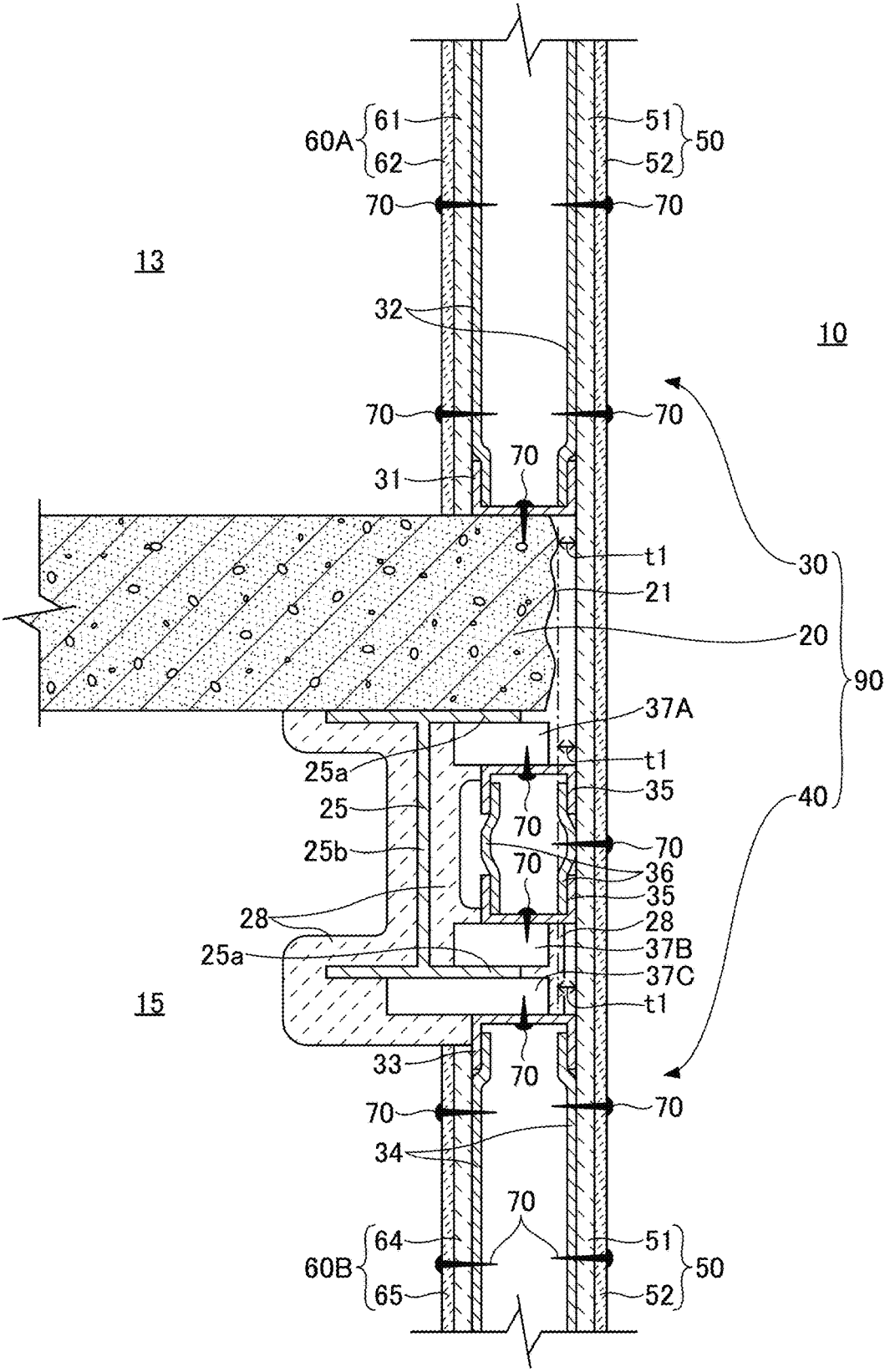
FIG.1 RELATED ART
FIG. 1 is a vertical cross-sectional view illustrating an example of a conventional connection structure between partition walls and a floor slab, in which a vertical compartment is separated from upper and lower floor rooms that are located adjacent to the vertical compartment and above and below the floor slab.
Figure 2:
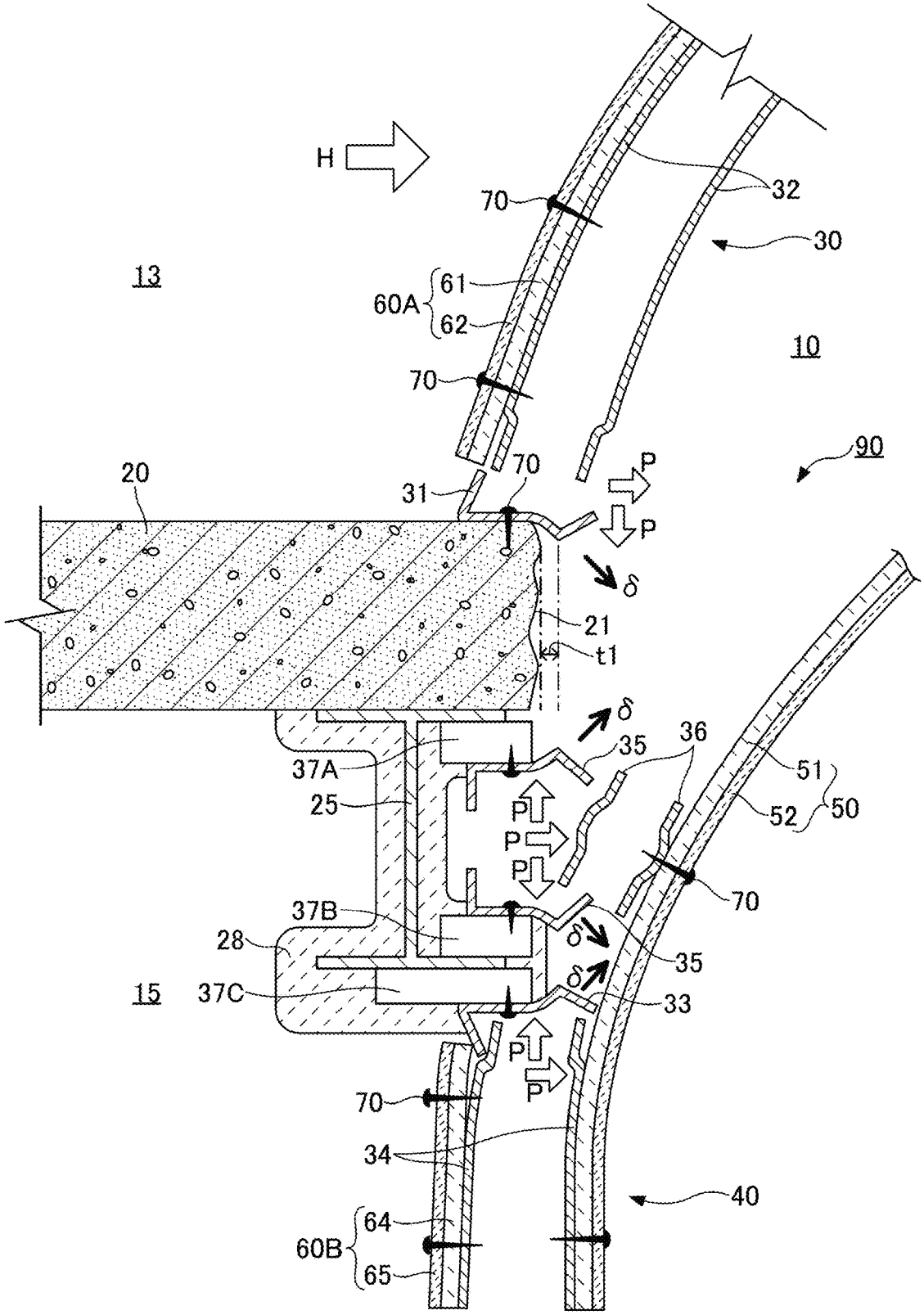
FIG.2 RELATED ART
FIG. 2 is a vertical cross-sectional view illustrating an example of a conventional connection structure between partition walls and a floor slab, which is damaged due to a horizontal force applied to the partition walls during an earthquake.

With an installation line L1 on which the first wall material 50 is installed in the vertical compartment 10 as a start line, the first stud 32, the second stud 34, and the floor beam stud 36 are set back by the thickness t2 of the first back batten 80A, the second back batten 80B, and the third back batten 80C, respectively, from the start line toward the upper floor room and the lower floor room. Further, the lower runner 31, the upper runner 33, and (the compartment side flanges 35*a* of) the floor beam runners 35 are set back by the width t3 toward the upper floor room and the lower floor room relative to the vertical-compartment-side end face 21 of the floor slab 20. Accordingly, as illustrated in FIG. 2, even if a horizontal force H is applied to the first partition wall 30 and the second partition wall 40 during an earthquake, and pressing forces P are applied from the first stud 32, the second stud 34, and the like to the lower runner 31, the upper runner 33, and the like, the lower runner 31, the upper runner 33, and the like do not deform. Accordingly, damage of the connection structure 100 due to deformation of the lower runner 31, the upper runner 33, and the like can be prevented.

Further, the first back batten 80A is interposed between the first stud 32 and the first wall material 50, the second back batten 80B is interposed between the second stud 34 and the first wall material 50, and the third back batten 80C are interposed between the floor beam stud 36 and the first wall material 50. With this configuration, even if the vertical-compartment-side end face 21 of the floor slab 20 made of reinforced concrete has projections and recesses due to an error when the floor slab 20 is constructed at a site, the first wall material 50 can be accurately attached to the first stud 32, the second stud 34, and the floor beam stud 36.

In the connection structure 100, a gap formed between the vertical-compartment-side end face 21 of the floor slab 20 and the first wall material 50 is filled with a refractory 85 formed of rock wool or the like. Further, a fire-resistant covering material 28 is formed in the surroundings of the floor beam 25 by spraying or the like. The fire-resistant covering material 28 is formed of, for example, a laminate of felt-like heat resistant rock wool and a fire retardant non-woven fabric.

As described, the first partition wall 30 and the second partition wall 40 are provided with fire resistance, the fire-resistant covering material 28 is provided in the surroundings of the floor beam 25, and the gap between the vertical-compartment-side end face 21 of the floor slab 20 and the first wall material 50 is filled with the refractory 85. Accordingly, the connection structure 100 excellent in fire resistance can be formed.

[Method for Constructing Connection Structure Between Partition Walls and Floor Slab According to Embodiment]

Figure 4:
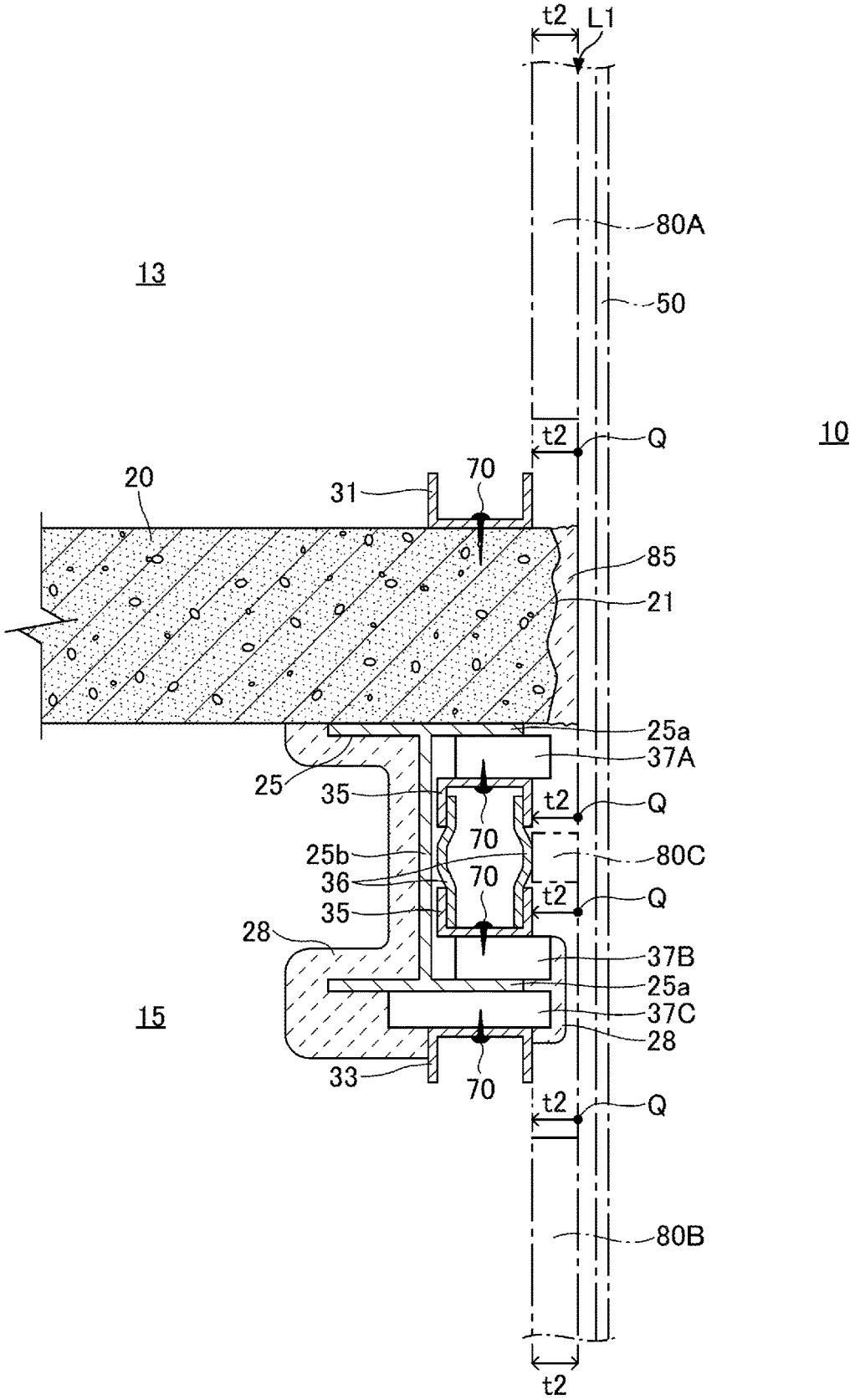
FIG. 4 is a drawing illustrating an example of a method for constructing a connection structure between partition walls and a floor slab according to an embodiment.
Figure 5:
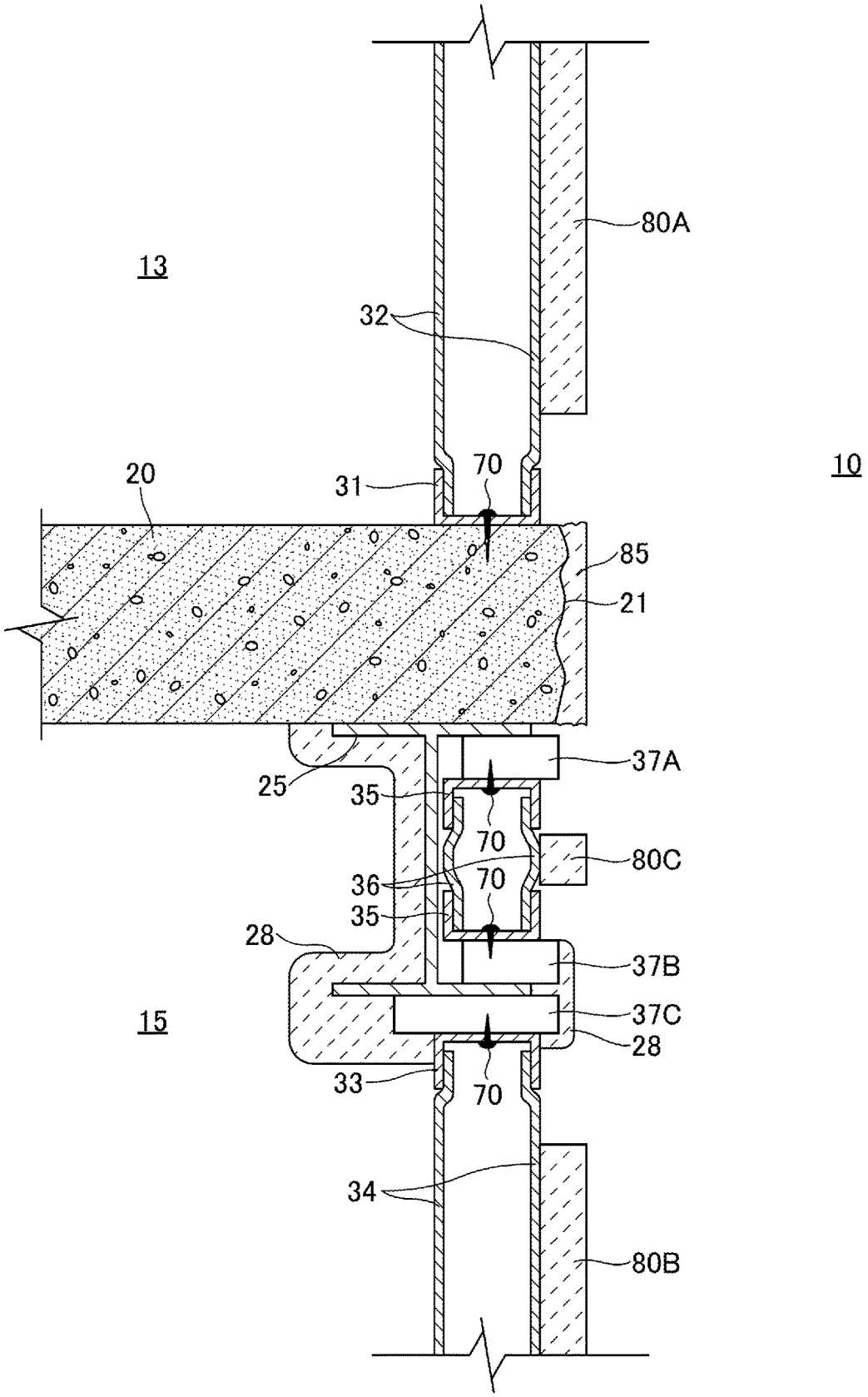
FIG. 5 is a drawing illustrating the example of the method for constructing the connection structure between the partition walls and the floor slab according to the embodiment.

Next, referring to FIG. 4 and FIG. 5 and also referring to FIG. 3 again, an example of a method for constructing a connection structure between partition walls and a floor slab according to an embodiment will be described. FIG. 4 and FIG. 5 are vertical cross-sectional views illustrating an example of a method for constructing a connection structure between partition walls and a floor slab according to an embodiment, and the method will be described with reference to FIG. 4, FIG. 5 and FIG. 3 in this order.

The method for constructing the connection structure according to the embodiment includes a floor slab construction process, a runner placement process, a stud installation process, and a partition wall forming process.

First, as illustrated in FIG. 4, the floor slab 20 made of reinforced concrete is constructed at a site, such that the floor slab 20 is supported by the floor beam 25 formed of H-shaped steel (the floor slab construction process).

Next, the lower runner 31, configured to accommodate the lower end of the first stud 32 that forms the first partition wall 30, is fixed to the top of the floor slab 20 by the fixing member 70. Further, the upper runner 33, configured to accommodate the upper end of the second stud 34 that forms the second partition wall 40, is fixed under the lower flange 25*a* of the floor beam 25 by the fixing member 70. The floor beam 25 supports the floor slab 20.

The runner receivers 37A and 37B are fixed to portions, on the vertical compartment side relative to the web 25*b*, of the upper and lower flanges 25*a* of the floor beam 25 by welding or the like. The upper and lower floor beam runners 35 are fixed to the runner receivers 37A and 37B by the fixing members 70, with the openings of the upper and lower floor beam runners 35 facing each other. The floor beam stud 36 is disposed within the upper and lower floor beam runners 35.

With the installation line L1 on which the first wall material 50 is installed in the vertical compartment 10 as a start line, the lower runner 31, the upper runner 33, and the floor beam runners 35 are positioned so as to be set back by the thickness t2 of the first back batten 80A, the second back batten 80B, and the third back batten 80C from start points Q on the installation line L1 toward the upper floor room and the lower floor room (the runner placement process). Note that, following the runner placement process, the fire-resistant covering material 28 is formed in the surroundings of the floor beam 25 by spraying or the like, and the refractory 85 is provided on the vertical-compartment-side end face 21 of the floor slab 20.

Next, as illustrated in FIG. 5, the lower end of the first stud 32 is accommodated and installed in the lower runner 31. Note that the upper end of the first stud 32 is fitted into the upper runner (not illustrated). Then, the first back batten 80A is attached to the surface on the vertical compartment side of the first stud 32.

Further, the upper end of the second stud 34 is accommodated and installed in the upper runner 33. Note that the lower end of the second stud 34 is fitted into the lower runner (not illustrated). Then, the second back batten 80B is attached to the surface on the vertical compartment side of the second stud 34.

Further, the third back batten 80C is attached to the surface on the vertical compartment side of the floor beam stud 36. The first back batten 80A, the second back batten 80B, and the third back batten 80C are temporarily secured to the first stud 32, the second stud 34, and the floor beam stud 36 with adhesive tapes (including double-sided adhesive tapes), adhesives, tapping screws, or the like. For example, acrylic resin-based adhesives, polyamide-based adhesives, natural rubber-based adhesives, synthetic rubber-based adhesives, or the like can be used. Further, adhesive tapes having a thickness of 3 mm or less and a width of 100 mm or less can be used.

Note that the third back batten 80C may be temporarily fixed to the floor beam stud 36 in advance, and when the floor beam stud 36 is placed in the runner placement process, the installation of the third back batten 80C may be completed at the same time (the stud installation process).

Next, as illustrated in FIG. 3, the first wall material 50 is fixed to the first stud 32 by the fixing member 70 through the first back batten 80A, fixed to the second stud 34 by the fixing member 70 through the second back batten 80B, and fixed to the floor beam stud 36 by the fixing member 70 through the third back batten 80C. The first wall material 50 extends from the first stud 32 to the second stud 34 in the vertical compartment 10. The first back batten 80A and the like, which are temporarily fixed to the first stud 32 and the like, are permanently fixed to the first stud 32 and the like firmly by the fixing members 70.

Further, the second wall material 63, forming the upper floor room 13, is fixed to the first stud 32 by the fixing member 70. Accordingly, the first partition wall 30 is formed by the second wall material 63, the first stud 32, the lower runner 31, the upper runner (not illustrated), and the first wall material 50.

Further, the third wall material 66, forming the lower floor room 15, is fixed to the second stud 34 by the fixing member 70. Accordingly, the second partition wall 40 is formed by the third wall material 66, the second stud 34, the upper runner 33, the lower runner (not illustrated), and first wall material 50, and the connection structure 100 is constructed (the partition wall forming process).

In the method for constructing the connection structure according to the embodiment, the lower runner 31, the upper runner 33, and the like are positioned so as to be set back by a predetermined amount toward the upper floor room and the lower floor room relative to the vertical-compartment-side end face 21 of the floor slab 20 having projections and recesses. Accordingly, damage of the lower runner 31 and the like due to an earthquake can be prevented. In addition, the first wall material 50 can be accurately attached to the first stud 32 and the like through the first back batten 80A and the like, thereby allowing the connection structure 100 to be efficiently constructed.

Other embodiments may be adopted in which other elements are combined with the elements of the above-described embodiment, and the present disclosure is not limited to the configurations shown herein. In this respect, changes may be made without departing from the intent of the present disclosure, and may be appropriately determined according to their form of application.

This application is based on and claims priority to Japanese Patent Application No. 2020-049538, filed on Mar. 19, 2020, the entire contents of which are incorporated herein by reference.

DESCRIPTION OF THE REFERENCE NUMERALS

10 vertical compartment
13 upper floor room
15 lower floor room
20 floor slab
25 floor beam
28 fire-resistant covering material
21 vertical-compartment-side end face
30 first partition wall
31 lower runner
32 first stud
33 upper runner
34 second stud
35 floor beam runner
36 floor beam stud
37A first runner receiver (runner receiver)
37B second runner receiver (runner receiver)
37C third runner receiver (runner receiver)
40 second partition wall
50 first wall material
51 base layer material
52 top layer material
60A, 63 second wall material
60B, 66 third wall material
61, 64 base layer material
62, 65 top layer material
70 fixing member
80A first back batten
80B second back batten
80C third back batten
85 refractory
100 connection structure between partition walls and floor slab (connection structure)

The invention claimed is:

1. A connection structure between partition walls and a floor slab, the connection structure being configured to connect an upper first partition wall and a lower second partition wall to the floor slab, the upper first partition wall and the lower second partition wall separating a vertical compartment from an upper floor room and a lower floor room that are located adjacent to the vertical compartment and above and below the floor slab, wherein a lower runner, configured to accommodate a lower end of a first stud that forms the first partition wall, is placed on the floor slab, wherein an upper runner, configured to accommodate an upper end of a second stud that forms the second partition wall, is placed below the floor slab, wherein a first wall material is fixed to the first stud through a first back batten and fixed to the second stud through a second back batten, the first wall material extending from the first stud to the second stud in the vertical compartment, wherein the first partition wall is formed by a second wall material, the first stud, the lower runner, and the first wall material, the second wall material forming the upper floor room, wherein the second partition wall is formed by a third wall material, the second stud, the upper runner, and the first wall material, the third wall material forming the lower floor room, wherein the first back batten extends in a vertical direction between the first stud and the first wall material, wherein the second back batten extends in the vertical direction between the second stud and the first wall material, wherein each of the first back batten and the second back batten has a same thickness, wherein the lower runner is set back by the thickness of the first back batten toward the upper floor room relative to an end face on a vertical compartment side of the floor slab, and wherein the upper runner is set back by the thickness of the second back batten toward the lower floor room relative to the end face on the vertical compartment side of the floor slab.

2. The connection structure between the partition walls and the floor slab according to claim 1, wherein the lower runner is fixed to the floor slab by a fixing member, and wherein the upper runner is fixed to a runner receiver by a fixing member, and the runner receiver is directly or indirectly fixed to the floor slab.

3. The connection structure between the partition walls and the floor slab according to claim 2, wherein the floor slab is supported by a floor beam, the runner receiver is fixed to the floor beam, and the upper runner is fixed to the runner receiver.

4. The connection structure between the partition walls and the floor slab according to claim 1, wherein a refractory is provided between the end face on the vertical compartment side of the floor slab and the first wall material.

5. The connection structure between the partition walls and the floor slab according to claim 1, wherein each of the first wall material, the second wall material, and the third wall material has a stacked structure in which a base layer material and a top layer material are stacked in a thickness direction of the partition walls.

6. A building comprising:

the connection structure between the partition walls and the floor slab according to claim 1.

7. A method for constructing a connection structure between partition walls and a floor slab, the connection structure being configured to connect an upper first partition wall and a lower second partition wall to the floor slab, the upper first partition wall and the lower second partition wall separating a vertical compartment from an upper floor room and a lower floor room that are located adjacent to the vertical compartment and above and below the floor slab, and the method comprising:

performing a runner placement process;

performing a stud installation process; and performing a partition wall forming process, wherein the runner placement process includes placing a lower runner on the floor slab, the lower runner being configured to accommodate a lower end of a first stud that forms the first partition wall, and placing an upper runner below the floor slab, the upper runner being configured to accommodate an upper end of a second stud that forms the second partition wall, wherein the stud installation process includes after accommodating and installing the lower end of the first stud in the lower runner, attaching a first back batten to a surface on a vertical compartment side of the first stud, and after accommodating and installing the upper end of the second stud in the second runner, attaching a second back batten to a surface on a vertical compartment side of the second stud, wherein the partition wall forming process includes fixing a first wall material to the first stud through the first back batten and to the second stud through the second back batten, the first wall material extending from the first stud to the second stud in the vertical compartment, fixing a second wall material to the first stud such that the first partition wall is formed by the second wall material, the first stud, the lower runner, and the first wall material, the second wall material forming the upper floor room, and fixing a third wall material to the second stud such that the second partition wall is formed by the third wall material, the second stud, the upper runner, and the first wall material, the third wall material forming the lower floor room, wherein the first back batten extends in a vertical direction between the first stud and the first wall material, wherein the second back batten extends in the vertical direction between the second stud and the first wall material, wherein each of the first back batten and the second back batten has a same thickness, wherein the lower runner is set back by the thickness of the first back batten toward the upper floor room relative to an end face on a vertical compartment side of the floor slab, and wherein the upper runner is set back by the thickness of the second back batten toward the lower floor room relative to the end face on the vertical compartment side of the floor slab.

8. The method for constructing the connection structure between the partition walls and the floor slab according to claim 7, further comprising:

performing a floor slab construction process for constructing the floor slab so to be supported by a floor beam, wherein, in the runner placement process, a runner receiver is fixed to the floor beam, and the upper runner is fixed to the runner receiver.

* * * * *